US008885005B2

(12) United States Patent
Masutani et al.

(10) Patent No.: US 8,885,005 B2
(45) Date of Patent: Nov. 11, 2014

(54) THERMAL HEAD AND THERMAL PRINTER PROVIDED WITH SAME

(75) Inventors: Hiroshi Masutani, Kirishima (JP); Yoshihiko Fujiwara, Kirishima (JP); Kouji Ochi, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 14/117,917

(22) PCT Filed: May 15, 2012

(86) PCT No.: PCT/JP2012/062407

§ 371 (c)(1),
(2), (4) Date: Nov. 15, 2013

(87) PCT Pub. No.: WO2012/157641

PCT Pub. Date: Nov. 22, 2012

(65) Prior Publication Data

US 2014/0232807 A1 Aug. 21, 2014

(30) Foreign Application Priority Data

May 16, 2011 (JP) ..... 2011-109945

(51) Int. Cl.
*B41J 2/335* (2006.01)

(52) U.S. Cl.
CPC ..... *B41J 2/3355* (2013.01); *B41J 2/3353* (2013.01)
USPC ..... 347/203

(58) Field of Classification Search
USPC ..... 347/200, 203, 205
See application file for complete search history.

(56) References Cited

U.S. PATENT DOCUMENTS

| | | | | |
|---|---|---|---|---|
| 7,484,834 | B2 * | 2/2009 | Inokuma | 347/64 |
| 8,319,809 | B2 * | 11/2012 | Nakagawa et al. | 347/208 |
| 8,325,209 | B2 * | 12/2012 | Masutani et al. | 347/203 |
| 8,493,423 | B2 * | 7/2013 | Aso et al. | 347/208 |
| 2006/0098052 | A1 * | 5/2006 | Inokuma | 347/64 |
| 2011/0187807 | A1 * | 8/2011 | Masutani et al. | 347/203 |

FOREIGN PATENT DOCUMENTS

| | | | |
|---|---|---|---|
| JP | 2003094707 | A | 4/2003 |
| JP | 2003103820 | A | 4/2003 |
| JP | 2010149515 | A | 7/2010 |
| JP | 2010194856 | A | 9/2010 |
| JP | 2011005715 | A | 1/2011 |

OTHER PUBLICATIONS

International Search Report, PCT/JP2012/062407, Jul. 19, 2012, 2 pp.

* cited by examiner

*Primary Examiner* — Huan Tran
(74) *Attorney, Agent, or Firm* — Volpe and Koenig, P.C.

(57) ABSTRACT

A thermal head and a thermal printer are disclosed. The thermal head includes a substrate, an electrode on the substrate, a heating portion connected to the electrode, and a protective layer on the heating portion. The protective layer includes a first layer and a second layer. The first layer is disposed on the heating portion and includes silicon carbonitride. The second layer is disposed on the first layer and includes silicon oxide.

11 Claims, 8 Drawing Sheets

THERMAL HEAD AND THERMAL PRINTER PROVIDED WITH SAME

FIELD OF INVENTION

The present invention relates to a thermal head and a thermal printer including the thermal head.

BACKGROUND

Various thermal heads have been proposed for printing devices, such as facsimile machines and video printers. For example, a thermal head described in Patent Literature 1 includes a substrate, an electrode on the substrate, a heating portion connected to the electrode, and a protective layer disposed on the heating portion. The protective layer of the thermal head includes a first layer formed of an inorganic material containing silicon oxide and/or silicon nitride, a second layer formed of sintered perhydropolysilazane, and a third layer formed of an inorganic material containing silicon nitride and/or silicon carbide (see Patent Literature 1).

CITATION LIST

PTL 1: Japanese Unexamined Patent Application Publication No. 2003-94707

SUMMARY

Technical Problem

However, the thermal head described in Patent Literature 1 may have poor thermal response because of the low thermal conductivity of the first layer.

Solution to Problem

A thermal head according to one aspect of the present invention includes a substrate, an electrode on the substrate, a heating portion connected to the electrode, and a protective layer disposed on the heating portion. The protective layer includes a first layer on the heating portion and a second layer on the first layer. The first layer contains silicon carbonitride, and the second layer contains silicon oxide.

A thermal printer according to another aspect of the present invention includes the thermal head, a transport mechanism for transporting a recording medium over the protective layer, and a platen roller for pressing the recording medium against the protective layer.

Advantageous Effects of Invention

The present invention can provide a thermal head having improved thermal response and a thermal printer including the thermal head.

DETAILED DESCRIPTION OF THE PREFERRED EMBODIMENTS

First Embodiment

Figure 1:
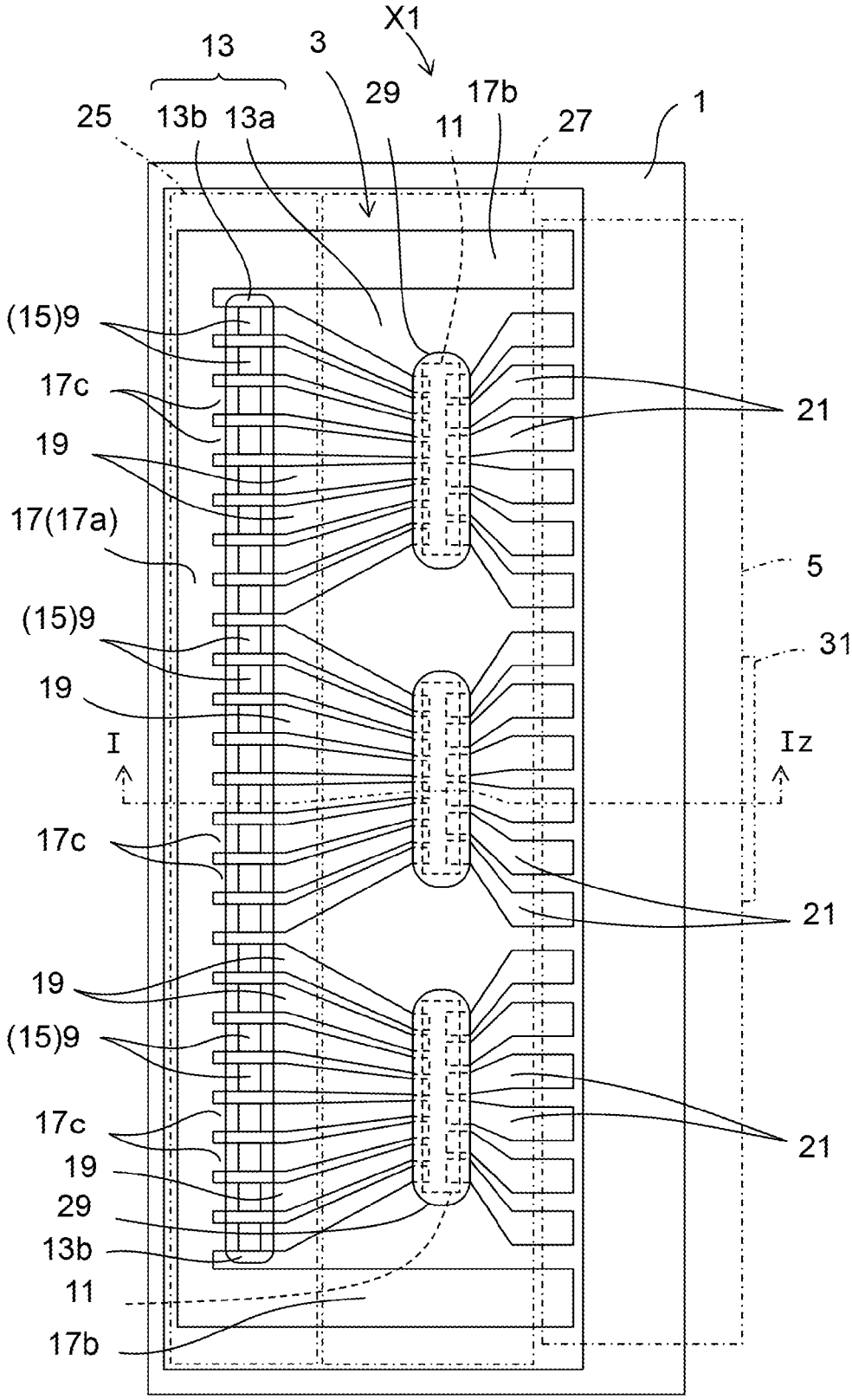
FIG. 1 is a plan view of a thermal head according to one embodiment of the present invention.
Figure 2:
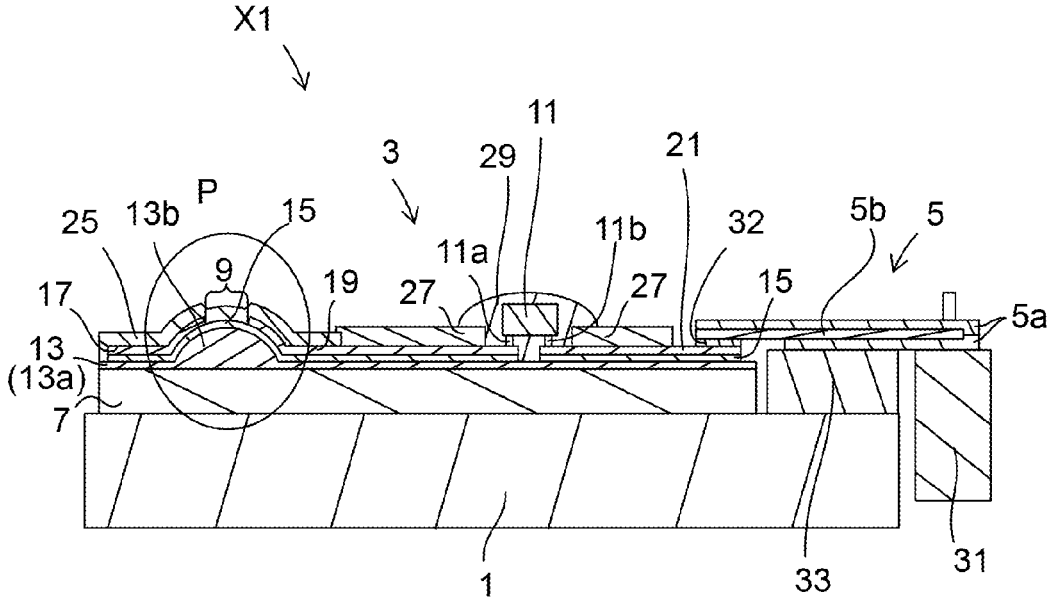
FIG. 2 is a cross-sectional view of the thermal head taken along the line I-I in FIG. 1.

A thermal head according to one embodiment of the present invention will be described below with reference to the drawings. As illustrated in FIGS. 1 and 2, a thermal head X1 according to the present embodiment includes a heat dissipator 1, a head base 3 on the heat dissipator 1, and a flexible printed circuit board 5 (hereinafter referred to as a FPC 5) connected to the head base 3. In FIG. 1, the FPC 5 is not shown, and only the footprint of the FPC 5 is indicated by a dash-dot line.

The heat dissipator 1 is a plate that is rectangular when viewed from the top. The heat dissipator 1 is formed of a metallic material, such as copper or aluminum, for example. The heat dissipator 1 has a function of radiating part of heat generated by heating portions 9 of the head base 3 and not contributing to printing. The heat dissipator 1 is bonded to the head base 3 with a double-sided tape or an adhesive (not shown).

The head base 3 includes a substrate 7, which is rectangular when viewed from the top, a plurality of heating portions 9 on the substrate 7 arranged in the longitudinal direction of the substrate 7, and a plurality of drive ICs 11 on the substrate 7 arranged in the array direction of the heating portions 9.

The substrate 7 is formed of an electrically insulating material, such as an alumina ceramic material, or a semiconductor material, such as single-crystal silicon.

A heat storage layer 13 is disposed on the substrate 7. The heat storage layer 13 includes an underlayer portion 13*a* on the entire surface of the substrate 7 and a raised portion 13*b* having a generally semielliptical cross section extending in the array direction of the heating portions 9. The raised portion 13*b* has a function of pressing a recording medium against a protective layer 25 described below disposed on the heating portions 9.

The heat storage layer 13 may be formed of a glass having a low thermal conductivity. The heat storage layer 13 temporarily stores part of heat generated by the heating portions 9 and thereby reduces the time required to increase the temperature of the heating portions 9 and has a function of enhancing the thermal response of the thermal head X1. The heat storage layer 13 may be formed by applying a glass paste containing a glass powder in an appropriate organic solvent to the substrate 7 by conventional screen printing and baking the glass paste.

As illustrated in FIG. 2, an electrical resistance layer 15 is disposed on the heat storage layer 13. The electrical resistance layer 15 on the heat storage layer 13 is overlaid with a common electrode 17, individual electrodes 19, and IC-FPC connecting electrodes 21 described below. As illustrated in FIG. 1, the thermal head X1 includes a region having the same shapes as the common electrode 17, the individual electrodes 19, and the IC-FPC connecting electrodes 21 when viewed from the top (hereinafter referred to as an interposed region) and 24 regions exposed between the common electrode 17 and the individual electrodes 19 (hereinafter referred to as exposed regions). In FIG. 1, the interposed region of the electrical resistance layer 15 is covered with the common electrode 17, the individual electrodes 19, and the IC-FPC connecting electrodes 21.

The exposed regions of the electrical resistance layer 15 form the heating portions 9. As illustrated in FIG. 1, the heating portions 9 are aligned on the raised portion 13*b* of the heat storage layer 13. The heating portions 9 simplified in FIG. 1 for convenience of explanation have a density in the range of 600 to 2400 dpi, for example.

The electrical resistance layer 15 is formed of a material having relatively high electrical resistance, such as TaN, TaSiO, TaSiNO, TiSiO, TiSiCO, or NbSiO. Thus, application of a voltage between the common electrode 17 and the individual electrodes 19 and supply of an electric current to the heating portions 9 cause the heating portions 9 to generate Joule heat.

As illustrated in FIGS. 1 and 2, the common electrode 17, a plurality of individual electrodes 19, and a plurality of IC-FPC connecting electrodes 21 are disposed on the electrical resistance layer 15, more specifically on the interposed regions. The common electrode 17, the individual electrodes 19, and the IC-FPC connecting electrodes 21 are formed of an electrically conductive material, for example, a metal selected from the group consisting of aluminum, gold, silver, and copper, or an alloy thereof.

The common electrode 17 connects the heating portions 9 to the FPC 5. As illustrated in FIG. 1, the common electrode 17 includes a main wiring portion 17*a*, secondary wiring portions 17*b*, and leads 17*c*. The main wiring portion 17*a* extends along the left long side of the substrate 7. Each of the secondary wiring portions 17*b* extends along the short sides of the substrate 7 and is connected to the main wiring portion 17*a* at one end thereof. Each of the leads 17*c* extends from the main wiring portion 17*a* to the heating portions 9 and is connected to the heating portions 9 at one end thereof. Each of the secondary wiring portions 17*b* of the common electrode 17 is connected to the FPC 5 at the other end thereof and electrically connects the FPC 5 to the heating portions 9.

The individual electrodes 19 connect the heating portions 9 to the drive ICs 11. As illustrated in FIGS. 1 and 2, each of the individual electrodes 19 extends in a band shape from the heating portions 9 to respective region of the drive ICs 11 such that one end of each of the individual electrodes 19 is connected to the heating portions 9 and the other end of each of the individual electrodes 19 is disposed in the region of the drive ICs 11. Each of the individual electrodes 19 is connected to the corresponding drive IC 11 at the other end and electrically connects the heating portions 9 to the drive ICs 11. More specifically, the heating portions 9 are divided into a plurality of groups, and each group of the heating portions 9 is electrically connected to the corresponding drive IC 11 via the individual electrodes 19.

In the present embodiment, the leads 17*c* of the common electrode 17 and the individual electrodes 19 are connected to the heating portions 9 as described above and are disposed on opposite sides of the heating portions 9. In this manner, the electrode wires connected to each of the heating portions 9 serving as an electrical resistor form a pair.

The IC-FPC connecting electrodes 21 connect the drive ICs 11 to the FPC 5. As illustrated in FIGS. 1 and 2, one end of each of the IC-FPC connecting electrodes 21 is disposed in the region of the drive ICs 11. The IC-FPC connecting electrodes 21 extend in a band shape such that the other end of each of the IC-FPC connecting electrodes 21 is disposed in the vicinity of the right long side of the substrate 7. Each of the IC-FPC connecting electrodes 21 is connected to the corresponding drive IC 11 at one end and the FPC 5 at the other end thereof. Thus, the drive ICs 11 are electrically connected to the FPC 5.

More specifically, the IC-FPC connecting electrodes 21 connected to the drive ICs 11 include a plurality of electric wires having different functions. For example, the IC-FPC connecting electrodes 21 include IC power supply wires (not shown), ground electrode wires (not shown), and IC control wires (not shown). The IC power supply wires have a function of supplying an electric current to operate the drive ICs 11. The ground electrode wires have a function of maintaining the drive ICs 11 and the individual electrodes 19 connected to the drive ICs 11 at a ground potential in the range of 0 to 1 V, for example. The IC control wires have a function of supplying electric signals to control the on-off state of switching elements in the drive ICs 11 described below.

As illustrated in FIGS. 1 and 2, each of the drive ICs 11 corresponds to a group of heating portions 9 and is connected to the other end of each of the individual electrodes 19 and one end of each of the IC-FPC connecting electrodes 21. The drive ICs 11 control the passage of an electric current through the heating portions 9 and include a plurality of switching elements. The electric current flows through the heating portions 9 when the switching elements are in the on state and is interrupted when the switching elements are in the off state. The drive ICs 11 may be existing drive ICs.

Although not shown in the drawings, each of the drive ICs 11 includes a plurality of switching elements corresponding to the individual electrodes 19 connected to the drive ICs 11. As illustrated in FIG. 2, in the drive ICs 11, one connection terminal 11*a* (hereinafter referred to as a first connection terminal 11*a*) connected to each of the switching elements is connected to the corresponding individual electrode 19. The other connection terminal 11*b* (hereinafter referred to as a second connection terminal 11*b*) connected to each of the switching elements is connected to the corresponding ground electrode wire of the IC-FPC connecting electrodes 21. Thus, when one of the switching elements of the drive ICs 11 is in the on state, the corresponding individual electrode 19 connected to the switching element is electrically connected to the correspond ground electrode wire of the IC-FPC connecting electrodes 21.

The electrical resistance layer 15, the common electrode 17, the individual electrodes 19, and the IC-FPC connecting electrodes 21 may be formed by stacking their material layers on the heat storage layer 13 by a well-known thin film forming technique, such as a sputtering process, and patterning the layered product by well-known photoetching. The common electrode 17, the individual electrodes 19, and the IC-FPC connecting electrodes 21 may be simultaneously formed by the same process.

As illustrated in FIGS. 1 and 2, the protective layer 25 that covers the heating portions 9, part of the common electrode 17, and part of the individual electrodes 19 is disposed on top of the heat storage layer 13 disposed on the substrate 7. In FIG. 1, for convenience of explanation, the protective layer 25 is not shown, and only the footprint thereof is indicated by a dash-dot line. The protective layer 25 covers a left side region of the top surface of the heat storage layer 13. More specifically, the protective layer 25 is disposed on the heating portions 9, the main wiring portion 17*a* of the common electrode 17, left side regions of the secondary wiring portions 17*b*, the leads 17*c*, and left side regions of the individual electrodes 19.

Figure 3:
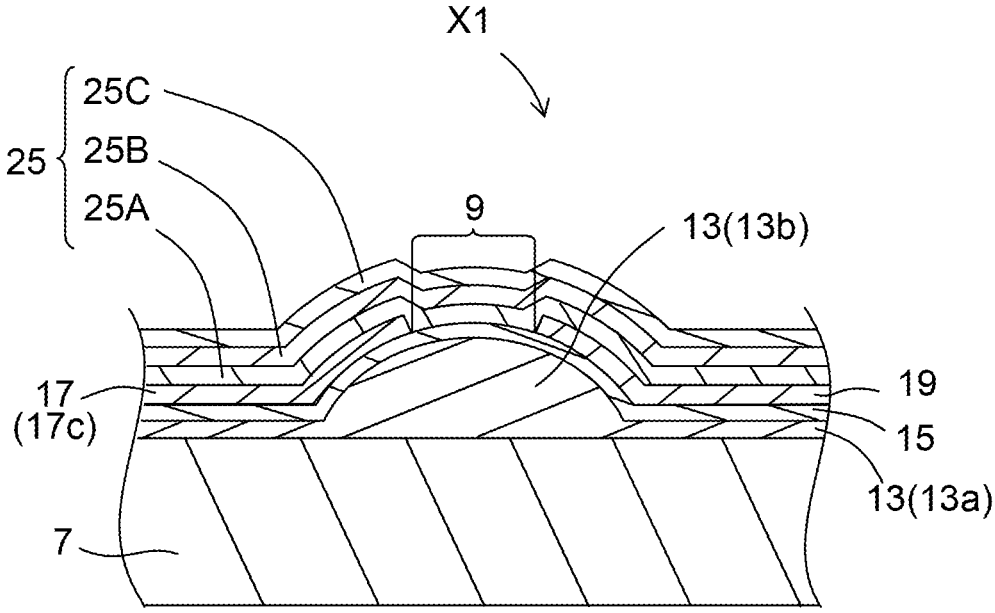
FIG. 3 is an enlarged view of a region P illustrated in FIG. 2.

The protective layer 25 protects the heating portions 9, the common electrode 17, and the individual electrodes 19 from corrosion due to the deposition of moisture or dust in the atmosphere or abrasion due to contact with a recording medium. As illustrated in FIG. 3, the protective layer 25 includes a first layer 25A (a first layer), which is disposed on the heating portions 9, the common electrode 17, and the individual electrodes 19, a second layer 25B (a second layer) on the first layer 25A, and a third layer 25C (a fourth layer) on the second layer 25B. The protective layer 25 is directly disposed on the heating portions 9, the common electrode 17, and the individual electrodes 19.

The layers constituting the protective layer 25 will be described below with reference to FIG. 3.

The first layer 25A is formed of silicon carbonitride (SiCN) and is an electrically insulating layer. The specific resistance of SiCN is in the range of $1\times10^{9}$ to $1\times10^{12}$ Ω·cm. The first layer 25A has a thickness in the range of 0.05 to 0.5 μm, for example. SiCN of the first layer 25A may include a nonstoichiometric component. The first layer 25A is directly formed on the heating portions 9, the common electrode 17, and the individual electrodes 19.

SiCN has a high thermal conductivity in the range of 0.05 to 0.15 W/m·K and can efficiently transfer heat generated by the heating portions 9. Thus, the thermal head X1 can have improved thermal response. The thermal head X1 therefore has high dot reproducibility and less printing irregularities.

SiCN has a thermal expansion coefficient of $10.0\times10^{-6}$/° C. in the printing temperature range of the thermal head X1. This is close to the thermal expansion coefficient of silicon oxide ($SiO_2$) of the second layer 25B described below ($8.0\times10^{-6}$/° C.). This can increase the adhesion between the first layer 25A and the second layer 25B and make the protective layer 25 resistant to detachment. Furthermore, being close in thermal expansion coefficient, the first layer 25A and the second layer 25B are resistant to detachment even when the thermal head X1 becomes hot, for example, during printing.

The first layer 25A is in contact with both the common electrode 17 and the individual electrodes 19, as illustrated in FIG. 3, and prevents a short circuit between the common electrode 17 and the individual electrodes 19 because of its electrical insulating properties as described above. In addition, the first layer 25A covers and protects the heating portions 9, the common electrode 17, and the individual electrodes 19. The first layer 25A formed of SiCN contains no oxygen atom. Thus, SiCN of the first layer 25A does not induce oxidation of the heating portions 9, the common electrode 17, and the individual electrodes 19.

The first layer 25A formed of SiCN is disposed on the heating portions 9, the common electrode 17, and the individual electrodes 19 and under the second layer 25B containing $SiO_2$. The first layer 25A can prevent oxygen of $SiO_2$ in the second layer 25B from diffusing into the heating portions 9, the common electrode 17, and the individual electrodes 19 and thereby prevent oxidation of the heating portions 9, the common electrode 17, and the individual electrodes 19.

Thus, the first layer 25A can prevent the electrical resistance of the heating portions 9, the common electrode 17, and the individual electrodes 19 from changing because of oxidation and thereby reduce the deviation of the heating temperature of the heating portions 9 from a predetermined temperature.

The second layer 25B formed of $SiO_2$ is disposed on the first layer 25A. The second layer 25B has a thickness in the range of 1.0 to 5.5 μm. $SiO_2$ of the second layer 25B may include a nonstoichiometric component. The second layer 25B has a function of sealing the heating portions 9, the common electrode 17, and the individual electrodes 19 in order to prevent these components from being exposed to the outside air. The second layer 25B is directly disposed on the first layer 25A.

The third layer 25C is disposed on the second layer 25B and is formed of silicon carbide (SiC). SiC has a Vickers hardness in the range of approximately 1800 to 2200 Hv. The third layer 25C formed of SiC can therefore serve as an abrasion resistant layer. The third layer 25C is directly disposed on the second layer 25B.

SiC has a specific resistance of $1\times10^{8}$ Ω·cm and is electrically conductive. Thus, the third layer 25C formed of SiC can discharge static electricity generated thereon and is less likely to be broken by static electricity.

The third layer 25C is formed by a non-bias sputtering process as described below. The third layer 25C has a thickness in the range of 1 to 6 μm. SiC of the third layer 25C has the chemical formula $Si_3C_4$ and may include a nonstoichiometric component. The third layer 25C may be formed of carbon-rich SiC (hereinafter also referred to as C—SiC). Even in such a case, the electrical conductivity can be further improved, and static electricity generated on the third layer 25C can be further discharged.

Preferably, the first layer 25A is formed of SiCN, the second layer 25B is formed of $SiO_2$, and the third layer is formed of SiC. In the formation of the constituent layers of the protective layer 25 having such compositions by the non-bias sputtering process, when the first layer 25A is formed using a sputtering target SiC and an Ar+N gas, the third layer 25C can also be formed using the same sputtering target SiC.

For example, when the protective layer 25 is formed with a sputtering apparatus that can use two sputtering targets SiC and $SiO_2$ in one batch, the first layer 25A, the second layer 25B, and the third layer 25C can be continuously formed without changing the batch. This can improve productivity. Since the protective layer 25 can be formed in one batch without changing the batch, the protective layer 25 can contain fewer impurities.

The protective layer 25 including the first layer 25A, the second layer 25B, and the third layer 25C may be formed as described below.

First, the first layer 25A is formed on the heating portions 9, the common electrode 17, and the individual electrodes 19 by the non-bias sputtering process. More specifically, the first layer 25A formed of SiCN is formed by the non-bias sputtering process using a sputtering target SiCN and Ar gas.

The first layer 25A may also be formed by the non-bias sputtering process using an $Ar+N_2$ gas. More specifically, the first layer 25A formed of SiCN may be formed by the non-bias sputtering process using a sputtering target SiC and an $Ar+N_2$ gas at a N/Ar molar ratio in the range of 10% to 80% by mole.

The second layer 25B is then formed on the first layer 25A by the non-bias sputtering process. More specifically, the second layer 25B formed of $SiO_2$ is formed by the non-bias sputtering process using a sputtering target $SiO_2$ and Ar gas.

The third layer 25C is then formed on the second layer 25B by the non-bias sputtering process. More specifically, the third layer 25C formed of SiC is formed by the non-bias sputtering process using a sputtering target SiC and Ar gas.

For the first layer 25A formed of C—SiCN, the first layer 25A can be formed by the non-bias sputtering process using a sputtering target C—SiCN and Ar gas. Alternatively, the first layer 25A formed of C—SiCN may be formed by the non-bias sputtering process using a sputtering target C—SiC and an $Ar+N_2$ gas.

Likewise, for the third layer 25C formed of C—SiC, the first layer 25A can be formed by the non-bias sputtering process using a sputtering target C—SiC and Ar gas.

In the formation of the first layer 25A, the heating portions 9 may be nitrided with an $Ar+N_2$ gas. For example, the heating portions 9 made of a TaSiO material may be nitrided with an $Ar+N_2$ gas to form the heating portions 9 partly made of a TaSiNO material.

The protective layer 25 including the first layer 25A, the second layer 25B, and the third layer 25C can be formed in this manner. The sputtering process used in the formation of these layers may be a known radio-frequency sputtering process.

As illustrated in FIGS. 1 and 2, a covering layer 27 that partly covers the common electrode 17, the individual electrodes 19, and the IC-FPC connecting electrodes 21 is disposed on top of the heat storage layer 13 disposed on the substrate 7. In FIG. 1, for convenience of explanation, the covering layer 27 is not shown, and only the footprint thereof is indicated by a dash-dot line. The covering layer 27 partly covers a region on top of the heat storage layer 13 on the right side of the protective layer 25. The covering layer 27 protects the common electrode 17, the individual electrodes 19, and the IC-FPC connecting electrodes 21 from oxidation due to contact with the atmosphere or corrosion due to the deposition of moisture and other substances in the atmosphere. In order to ensure the protection of the common electrode 17 and the individual electrodes 19, the covering layer 27 may overlap an end of the protective layer 25, as illustrated in FIG. 2. The covering layer 27 may be formed of a resin material, such as an epoxy resin or a polyimide resin. The covering layer 27 can be formed by a thick film forming technique, such as a screen printing process.

As illustrated in FIGS. 1 and 2, ends of the secondary wiring portions 17*b* of the common electrode 17 and the IC-FPC connecting electrodes 21 to be connected to the FPC 5 described below are exposed from the covering layer 27 in order to be connected to the FPC 5 as described below.

The covering layer 27 has an opening through which ends of the individual electrodes 19 and the IC-FPC connecting electrodes 21 are exposed and connected to the drive ICs 11. The drive ICs 11 connected to the individual electrodes 19 and the IC-FPC connecting electrodes 21 and the connections between the drive ICs 11 and the individual electrodes 19 and the IC-FPC connecting electrodes 21 are sealed with a covering member 29 made of a resin, such as an epoxy resin or a silicon resin.

As illustrated in FIGS. 1 and 2, the FPC 5 extends in the longitudinal direction of the substrate 7 and is electrically connected to the secondary wiring portions 17*b* of the common electrode 17 and the IC-FPC connecting electrodes 21. The FPC 5 is a known flexible printed circuit board containing a plurality of printed circuits in an insulating resin layer. Each of the printed circuits is electrically connected to an external power supply and an external controller (not shown) through the connector 31. The printed circuits are generally formed of metallic foil, such as copper foil, an electrically conductive thin film formed by a thin film forming technique, or an electrically conductive thick film formed by a thick film printing technique. The printed circuits formed of metallic foil or an electrically conductive thin film may be patterned by partial etching by photoetching.

More specifically, as illustrated in FIG. 2, each printed circuit 5*b* in an insulating resin layer 5*a* of the FPC 5 is exposed at one end on the head base 3 side and is electrically connected to an end of the secondary wiring portions 17*b* of the common electrode 17 and an end of the IC-FPC connecting electrodes 21 with a jointing member 32 (see FIG. 2), for example, made of an electrically conductive jointing material, such as a solder material, or an anisotropic conductive film (ACF) containing electrically conductive particles in an electrically insulating resin.

When the printed circuits 5*b* of the FPC 5 are electrically connected to an external power supply and an external controller (not shown) through the connector 31, the common electrode 17 is electrically connected to a positive terminal of the power supply, for example, held at a positive potential in the range of 20 to 24 V. The individual electrodes 19 are electrically connected to a negative terminal of the power supply held at a ground potential in the range of 0 to 1 V through the drive ICs 11 and the ground electrode wires of the IC-FPC connecting electrodes 21. Thus, when one of the switching elements of the drive ICs 11 is in the on state, an electric current is supplied to the corresponding heating portion 9, and the heating portion 9 generates heat.

Likewise, when the printed circuits 5*b* of the FPC 5 are electrically connected to the external power supply and controller (not shown) through the connector 31, the IC power supply wires of the IC-FPC connecting electrodes 21 are electrically connected to a positive terminal of the power supply held at a positive potential, as in the common electrode 17. Thus, because of the potential difference between the IC power supply wires of the IC-FPC connecting electrodes 21 connected to the drive ICs 11 and the ground electrode wires, an electric current for the operation of the drive ICs 11 is supplied to the drive ICs 11. The IC control wires of the IC-FPC connecting electrodes 21 are electrically connected to an external controller for controlling the drive ICs 11. Thus, electric signals from the controller are sent to the drive ICs 11. Electric signals cause the drive ICs 11 to control the on-off state of each of the switching elements in the drive ICs 11 and thereby cause a selected one of the heating portions 9 to generate heat.

A reinforcing plate 33 made of a resin, such as a phenolic resin, a polyimide resin, or a glass-epoxy resin, is disposed between the FPC 5 and the heat dissipator 1. Although not shown in the figure, the reinforcing plate 33 is bonded to the undersurface of the FPC 5, for example, with a double-sided tape or an adhesive and reinforces the FPC 5. The reinforcing plate 33 is also bonded to the heat dissipator 1, for example, with a double-sided tape or an adhesive, and consequently the FPC 5 is fixed on top of the heat dissipator 1.

Figure 4:
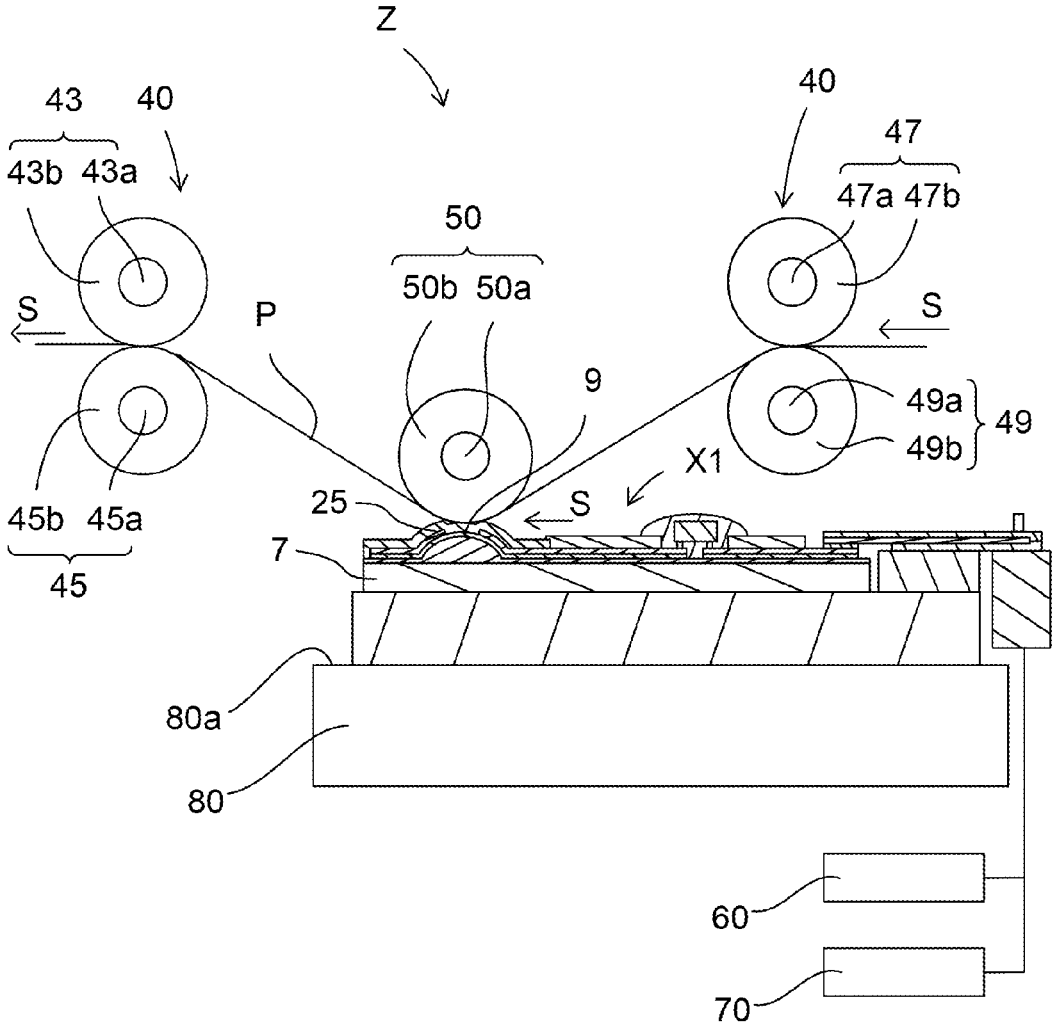
FIG. 4 is a schematic view of a thermal printer according to one embodiment of the present invention.

A thermal printer according to one embodiment of the present invention will be described below with reference to FIG. 4. FIG. 4 is a schematic view of a thermal printer Z according to the present embodiment.

As illustrated in FIG. 4, the thermal printer Z according to the present embodiment includes the thermal head X1, a transport mechanism 40, a platen roller 50, a power supply 60, and a controller 70. The thermal head X1 is mounted on a mounting surface 80*a* of a mounting member 80 attached to the housing of the thermal printer Z. The thermal head X1 is mounted on the mounting member 80 such that the array direction of the heating portions 9 is the main scanning direction perpendicular to the transport direction S of a recording medium P described below, that is, the direction perpendicular to the drawing of FIG. 4.

The transport mechanism 40 transports the recording medium P, such as a thermal paper or a receiver paper to which an ink is to be transferred, in the direction of the arrow in FIG. 4 onto the heating portions 9 of the thermal head X1, more specifically, onto the protective layer 25. The transport mechanism 40 includes transport rollers 43, 45, 47, and 49. The transport rollers 43, 45, 47, and 49 may be cylindrical shafts 43*a*, 45*a*, 47*a*, and 49*a* made of a metal, such as stainless steel, covered with elastic members 43*b*, 45*b*, 47*b*, and 49*b* made of butadiene rubber. Although not shown in the figure, in the case that the recording medium P is a receiver paper to which an ink is to be transferred, an ink film is also transported together with the recording medium P between the recording medium P and the heating portions 9 of the thermal head X1.

The platen roller 50 presses the recording medium P against the heating portions 9 of the thermal head X1 and extends in the direction perpendicular to the transport direction of the recording medium P. The platen roller 50 is rotatably supported at both ends thereof while pressing the recording medium P against the heating portions 9. The platen roller 50 may be a cylindrical shaft 50*a* made of a metal, such as stainless steel, covered with an elastic member 50*b* made of butadiene rubber.

The power supply 60 supplies an electric current for the heat generation of the heating portions 9 of the thermal head X1 and an electric current for the operation of the drive ICs 11, as described above. The controller 70 sends control signals for the operation of the drive ICs 11 to the drive ICs 11 in order for the heat generation of a selected one of the heating portions 9 of the thermal head X1, as described above.

As illustrated in FIG. 4, in the thermal printer Z according to the present embodiment, the power supply 60 and the controller 70 allow selective heat generation of the heating portions 9 while the platen roller 50 presses the recording medium against the heating portions 9 of the thermal head X1 and the transport mechanism 40 transports the recording medium P onto the heating portions 9. Thus, the thermal printer Z can print intended images on the recording medium P. When the recording medium P is a receiver paper, an ink of an ink film transported together with the recording medium P is thermally transferred to the recording medium P to print images on the recording medium P.

Second Embodiment

A thermal head X2 according to a second embodiment will be described below with reference to FIG. 5.

Figure 5:
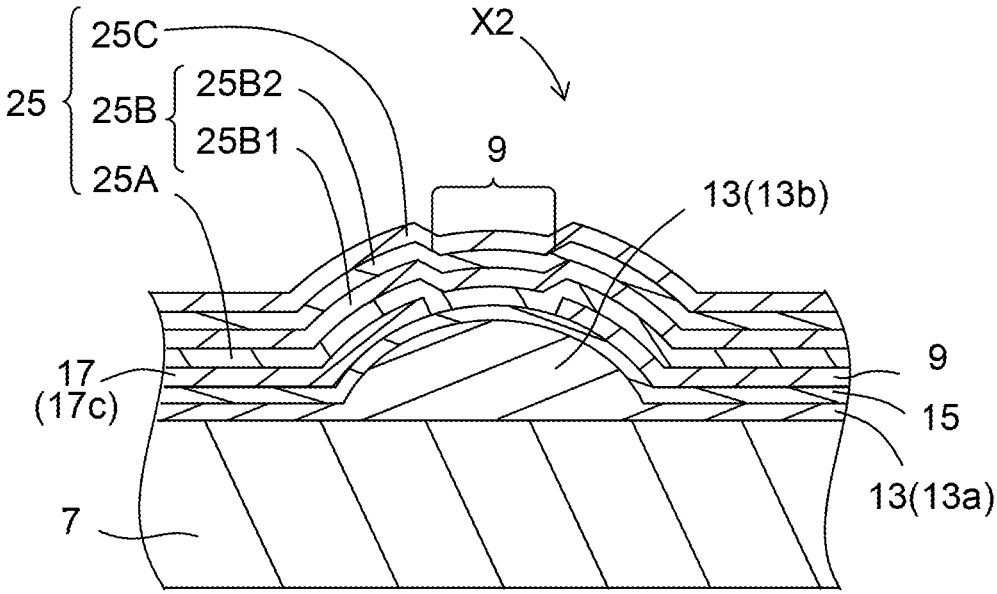
FIG. 5 is an enlarged view of a thermal head according to another embodiment of the present invention corresponding to the region P illustrated in FIG. 2.

The thermal head X2 illustrated in FIG. 5 is the same as the thermal head X1 except that a protective layer 25 includes a first layer 25A, a second layer 25B including an adhesion layer 25B1 (a second layer) and a dense layer 25B2 (a third layer) disposed on the first layer 25A, and a third layer 25C disposed on the dense layer 25B2. Like reference numerals designate like parts, and the same applies hereinafter.

The second layer 25B is formed of SiC and $SiO_2$ and includes the adhesion layer 25B1 disposed on the first layer 25A and the dense layer 25B2 disposed on the adhesion layer 25B1. The second layer 25B formed of SiC and $SiO_2$ can have high adhesion to the first layer 25A formed of SiCN and improve the bonding strength between the first layer 25A and the second layer 25B. When the third layer 25C is formed of SiC, the second layer 25B can have high adhesion to the third layer 25C and improve the bonding strength between the third layer 25C and the second layer 25B.

The SiC content of the adhesion layer 25B1 is preferably in the range of 1.1% to 2.1% by mole. This can improve the thermal conductivity of the adhesion layer 25B1 while $SiO_2$ ensures good sealing. Thus, the thermal head X2 can have improved thermal response.

The SiC content of the dense layer 25B2 is preferably in the range of 5.9% to 11.2% by mole. This can improve the thermal conductivity of the dense layer 25B2 while $SiO_2$ ensures good sealing. Thus, the thermal head X2 can have improved thermal response.

Since the SiC content of the dense layer 25B2 is higher than the SiC content of the adhesion layer 25B1, this can improve adhesion between the third layer 25C and the dense layer 25B2.

The thermal conductivity of the dense layer 25B2 farther from the heating portions 9 can be higher than the thermal conductivity of the adhesion layer 25B1 closer to the heating portions 9. Thus, heat of the heating portions 9 can be accurately transferred to the surface of the protective layer 25 in contact with a recording medium (not shown). This improves image quality.

In the thermal head X2, the carbon content of the adhesion layer 25B1 is lower than the carbon content of the first layer 25A. Thus, the carbon content of the adhesion layer 25B1 is lower than the carbon contents of the first layer 25A and the dense layer 25B2.

Consequently, the protective layer 25 includes the adhesion layer 25B1 having a low thermal conductivity between the first layer 25A and the dense layer 25B2. Thus, the adhesion layer 25B1 serves as a heat storage that temporarily stores heat from the heating portions 9.

The adhesion layer 25B1 is formed by the non-bias sputtering process as described below. The adhesion layer 25B1 has a thickness in the range of 0.5 to 2.5 μm, for example. The dense layer 25B2 is formed by a bias sputtering process as described below. The dense layer 25B2 has a thickness in the range of 0.5 to 3 μm, for example.

The adhesion layer 25B1 formed by the non-bias sputtering process has lower residual stress than the dense layer 25B2 formed by the bias sputtering process. In addition, the dense layer 25B2 has a higher density than the adhesion layer 25B1.

More specifically, the dense layer 25B2 formed by the bias sputtering process has 2 to 5 times higher residual stress than the adhesion layer B1 formed by the non-bias sputtering process and can therefore have a higher density.

Figure 6:
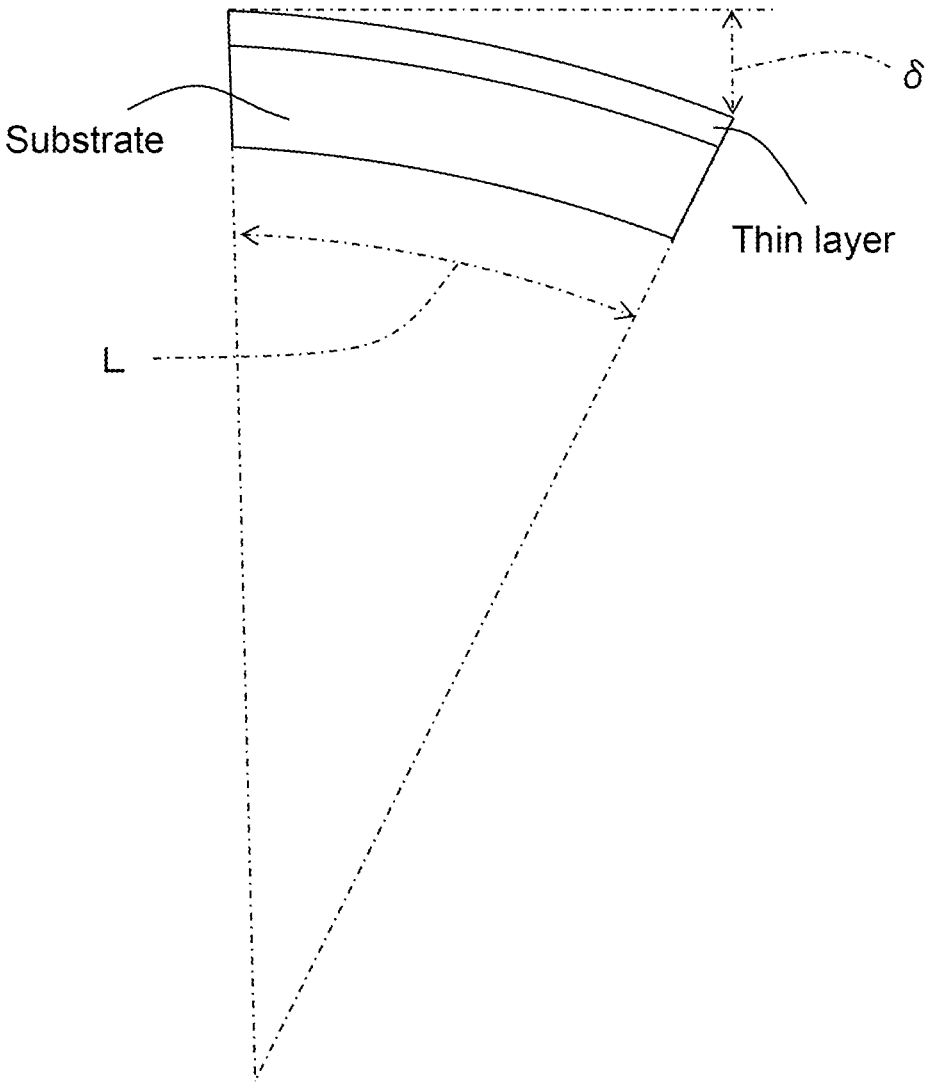
FIG. 6 is an explanatory view of a method for measuring residual stress.

The residual stress of the adhesion layer 25B1 and the dense layer 25B2 of the second layer 25B can be determined from the displacement of a curved rectangular substrate. As illustrated in FIG. 6, a thin film is formed on a surface of a rectangular substrate by sputtering. Assuming that the cross section of a curved substrate is an arc, the residual stress can be determined from the displacement δ.

More specifically, the residual stress δ can be calculated from the formula $E \times b^2 \times 3^{-1} \times (1-v)^{-1} \times L^{-2} \times d^{-1} \times \delta$, wherein E denotes the Young's modulus of the substrate, v denotes the Poisson's ratio of the substrate, L denotes the length of the substrate, b denotes the thickness of the substrate, d denotes the thickness of the thin film, and δ denotes the displacement of the substrate. The residual stress can also be determined using an X-ray diffraction method or a Newton's rings method.

The non-bias sputtering process, as used herein, refers to a known sputtering process in the absence of a bias voltage on a substrate on which a film is to be formed. In a known bias sputtering process, a bias voltage is applied to a substrate on which a film is to be formed.

A method for forming the protective layer 25 of the thermal head according to the second embodiment will be described below. First, the first layer 25A is formed by the non-bias sputtering process. More specifically, the first layer 25A formed of SiCN is formed by the non-bias sputtering process using a sputtering target SiCN.

The adhesion layer 25B1 and the dense layer 25B2 of the second layer 25B are then successively formed on the first layer 25A by the non-bias sputtering process and the bias sputtering process, respectively. More specifically, the adhesion layer 25B1 composed of $SiO_2$ and SiC is first formed on the substrate 7 side by the non-bias sputtering process using a sputtering target $SiO_2$ and SiC in the absence of a bias voltage. Subsequently, the dense layer 25B2 composed of $SiO_2$ and SiC is formed on the substrate 7 side by the bias sputtering process using the same sputtering target $SiO_2$ and SiC in the presence of a bias voltage. The third layer 25C is formed on the dense layer 25B2 of the second layer 25B by a sputtering process. More specifically, the third layer 25C formed of SiC is formed by the non-bias sputtering process using a sputtering target SiC, thereby completing the protective layer 25.

Thus, the second layer 25B containing $SiO_2$ and SiC includes the adhesion layer 25B1 formed on the first layer 25A by the non-bias sputtering process and the dense layer 25B2 formed on the adhesion layer 25B1 by the bias sputtering process. This can prevent detachment of the second layer 25B from the first layer 25A and improve sealing with the second layer 25B.

In the thermal head X1 according to the second embodiment, the adhesion layer 25B1 formed by the non-bias sputtering process has lower residual stress than the dense layer 25B2 formed by the bias sputtering process. This can reduce the likelihood of detachment of the second layer 25B from the first layer 25A, for example, as compared with the case where the dense layer 25B2 is directly formed on the first layer 25A by the bias sputtering process or the adhesion layer 25B1 on the first layer 25A is formed by the bias sputtering process.

The dense layer 25B2 formed by the bias sputtering process has a higher density than the adhesion layer 25B1 formed by the non-bias sputtering process. This can improve sealing with the second layer 25B, for example, as compared with the case where the dense layer 25B2 is not formed on the adhesion layer 25B1 or the dense layer 25B2 on the adhesion layer 25B1 is formed by the non-bias sputtering process. This can prevent moisture and other substances in the atmosphere from entering the second layer 25B and protect the heating portions 9, the common electrode 17, and the individual electrodes 19 from corrosion due to the deposition of moisture and other substances.

The SiC contents of the adhesion layer 25B1 and the dense layer 25B2 can be controlled with a RF voltage applied to the sputtering target SiC. The SiC contents of the adhesion layer 25B1 and the dense layer 25B2 may also be controlled by another known method.

As exemplified above for comparison purposes, when a thin film layer is directly formed on the first layer 25A by the bias sputtering process, the surface of the first layer 25A will be worn away. In particular, regions of the first layer 25A covering the ends of the common electrode 17 and the individual electrodes 19 (hereinafter referred to as electric wire end covering regions) tends to have a reduced thickness. When both the adhesion layer 25B1 on the first layer 25A and the dense layer 25B2 on the adhesion layer 25B1 are formed by the bias sputtering process, an electric wire end covering region of the adhesion layer 25B1 and the dense layer 25B2 tends to have a reduced thickness.

In contrast, in the thermal head X2 according to the second embodiment, since the adhesion layer 25B1 on the first layer 25A is formed by the non-bias sputtering process, the surface of the first layer 25A is resistant to abrasion, and the thickness of the electric wire end covering region of the first layer 25A is negligibly reduced. The thickness of the electric wire end covering region of the adhesion layer 25B1 is also negligibly reduced. Thus, the thickness of the electric wire end covering region of the first layer 25A and the adhesion layer 25B1 can be increased to improve sealing with the insulating layer 25A and the adhesion layer 25B1. Since the third layer 25C is electrically conductive in the present embodiment, maintaining an adequate thickness of the first layer 25A can prevent static electricity from leaking from the third layer 25C into the common electrode 17 and the individual electrodes 19.

Although the adhesion layer 25B1 is formed by the non-bias sputtering process and the dense layer 25B2 is formed by the bias sputtering process in the thermal head X2 according to the second embodiment, the present invention is not limited to this. Both the adhesion layer 25B1 and the dense layer 25B2 may be formed by the non-bias sputtering process.

Third Embodiment

A thermal head X3 according to the third embodiment will be described below with reference to FIGS. 7 and 8.

Figure 7:
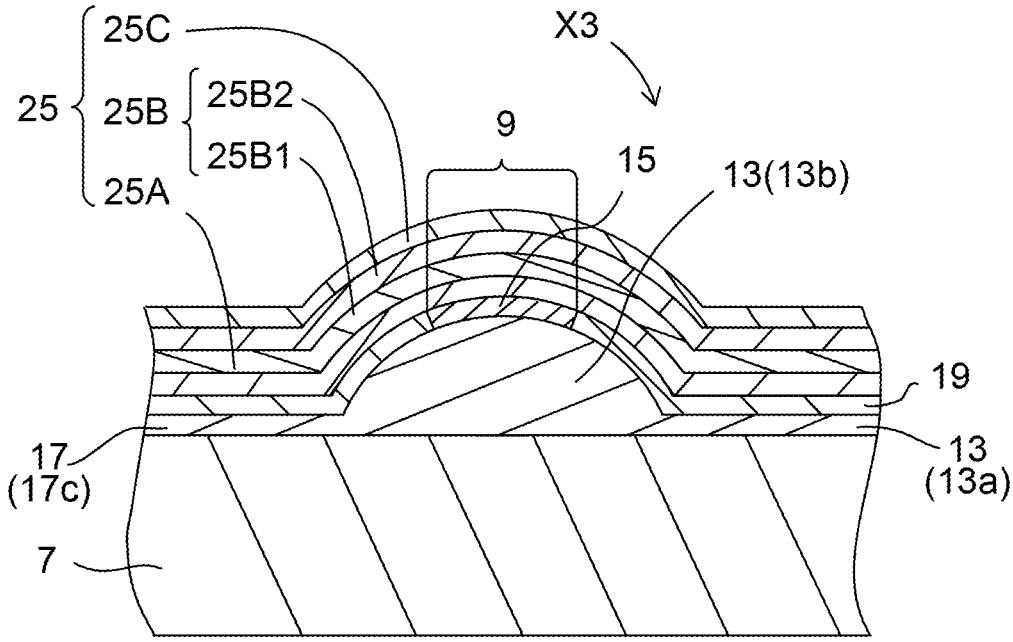
FIG. 7 is an enlarged view of a thermal head according to still another embodiment of the present invention corresponding to the region P illustrated in FIG. 2.

As illustrated in FIG. 7, the thermal head X3 includes a common electrode 17 and individual electrodes 19 on a heat storage layer 13, and an electrical resistance layer 15 on the heat storage layer 13 on which the common electrode 17 and the individual electrode 19 are formed. In this case, a region of the electrical resistance layer 15 between the common electrode 17 and the individual electrodes 19 forms a heating portion 9. Such a structure can reduce the occurrence of a difference in level on a surface of a protective layer 25 in contact with a recording medium (not shown), thereby improving the contact between the thermal head X3 and the recording medium.

Figure 8:
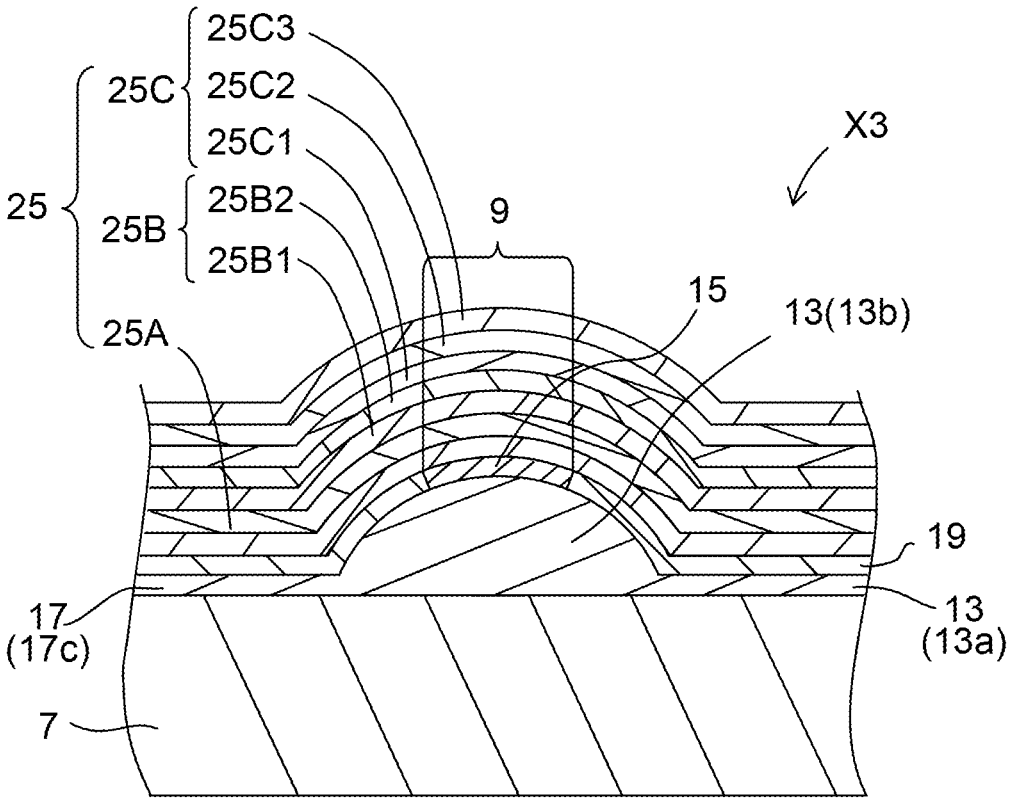
FIG. 8 is an enlarged view of a modified example of the thermal head illustrated in FIG. 7 corresponding to the region P illustrated in FIG. 2.

A thermal head X3' illustrated in FIG. 8 is a modified example of the thermal head X3 and includes a third layer 25C including a lower layer 25C1 (a fourth layer), a middle layer 25C2 (a fifth layer) on the lower layer 25C1, and an upper layer 25C3 (a sixth layer) on the middle layer 25C2.

The lower layer 25C1 is formed of SiON. The middle layer 25C2 is formed of SiC. The upper layer 25C3 is formed of SiON. Such a structure can improve the smoothness of the third layer 25C and reduce the likelihood of sticking between the third layer 25C and a recording medium (not shown).

The lower layer 25C1 has a function of improving the adhesion between the middle layer 25C2 and the dense layer 25B2. The lower layer 25C1 can improve the adhesion between the middle layer 25C2 and the dense layer 25B2 and increase the bonding strength between the middle layer 25C2 and the dense layer 25B2.

The middle layer 25C2 serves as an abrasion resistant layer that reduces abrasion of the protective layer 25 due to contact with a recording medium. The middle layer 25C2 can improve the abrasion resistance of the protective layer 25.

The upper layer 25C3 has a function of improving the slidability of a recording medium. The upper layer 25C3 serving as the top layer of the protective layer 25 that will come into contact with a recording medium can improve the slidability of the recording medium and reduce the likelihood of sticking between the protective layer 25 and the recording medium.

Although the embodiments of the present invention are described above, the present invention is not limited to these embodiments. Various modifications may be made in these embodiments without departing from the gist of the present invention.

Although the third layer 25C is formed of SiC in the thermal head X1 according to one of the embodiments described above, the third layer 25C may be formed of silicon nitride (SiN) having the chemical formula $Si_3N_4$ or tantalum pentoxide ($Ta_2O_5$). SiN or $Ta_2O_5$ of the third layer 25C may include a nonstoichiometric component. The third layer 25C formed of SiN may be formed by the non-bias sputtering process using a sputtering target SiN. The third layer 25C formed of $Ta_2O_5$ may be formed by the non-bias sputtering process using a sputtering target $Ta_2O_5$.

Although the thermal head X1 illustrated in FIGS. 1 to 3 includes the raised portion 13*b* in the heat storage layer 13 and the electrical resistance layer 15 on the raised portion 13*b*, the present invention is not limited to this. For example, the heat storage layer 13 may include no raised portion 13*b*, and the heating portions 9 of the electrical resistance layer 15 may be disposed on the underlayer portion 13*a* of the heat storage layer 13. Alternatively, the electrical resistance layer 15 may be disposed on the substrate 7 without the heat storage layer 13.

Although the heating portions 9 are disposed on a flat surface on top of the substrate 7, the heating portions 9 may be disposed on a side surface of the substrate 7. More specifically, the heating portions 9 may be disposed on a side surface between one main surface and the other main surface of the substrate 7. Also in such a case, the thermal head has improved thermal response.

Although the external circuit board connected to the head base 3 is the FPC, the present invention is not limited to this. For example, the external circuit board may be a rigid substrate made of a cured organic resin.

Although the thermal heads X1 to X3 include the third layer 25C on the second layer 25B, the present invention is not limited to this. Even when the protective layer 25 only includes the first layer 25A and the second layer 25B, the thermal head X1 can have improved thermal response because of the inclusion of SiCN in the first layer 25A.

REFERENCE SIGNS LIST

X1 to X3 thermal head
Z thermal printer
1 heat dissipator
3 head base
5 flexible printed circuit board
7 substrate
9 heating portion
11 drive IC
17 common electrode
17*a* main wiring portion
17*b* secondary wiring portion
17*c* lead
19 individual electrode
21 IC-FPC connecting electrode
25 protective layer
25A first layer
25B second layer
25B1 adhesion layer
25B2 dense layer
25C third layer
25C1 lower layer
25C2 middle layer
25C3 upper layer
27 covering layer

What is claimed is:

1. A thermal head, comprising:
a substrate;
an electrode on the substrate;
a heating portion connected to the electrode; and
a protective layer on the heating portion,
wherein the protective layer comprises:
a first layer on the heating portion, comprising silicon carbonitride; and
a second layer on the first layer, comprising silicon oxide.

2. The thermal head according to claim 1, wherein
the protective layer further comprises a third layer on the second layer,
the second layer further comprises silicon carbide, and
the third layer comprises silicon oxide and silicon carbide.

3. The thermal head according to claim 2, wherein
the silicon carbide content of the third layer is higher than the silicon carbide content of the second layer.

4. The thermal head according to claim 2, wherein the carbon content of the second layer is lower than the carbon content of the first layer.

5. The thermal head according to claim 2, wherein the residual stress of the second layer is lower than the residual stress of the third layer.

6. The thermal head according to claim 2, wherein a silicon carbide content of the second layer is in the range of 1.1% to 2.1% by mole.

7. The thermal head according to claim 2, wherein a silicon carbide content of the third layer is in the range of 5.9% to 11.2% by mole.

8. The thermal head according to claim 2, wherein the third layer has a higher density than the second layer.

9. The thermal head according to claim 2, wherein the protective layer further comprises a fourth layer on the third layer, the fourth layer comprising silicon carbide, silicon nitride, silicon carbonitride, or tantalum pentoxide.

10. A thermal printer, comprising:
a thermal head according to claim 1;
a transport mechanism for transporting a recording medium on the protective layer; and
a platen roller for pressing the recording medium against the protective layer.

11. The thermal head according to claim 1, wherein the protective layer further comprising:
a fourth layer on the third layer, comprising SiON;
a fifth layer on the fourth layer, comprising SiC; and
a sixth layer on the fifth layer, comprising SiON.

* * * * *